US007004313B2

(12) United States Patent
Mitchell et al.

(10) Patent No.: US 7,004,313 B2
(45) Date of Patent: Feb. 28, 2006

(54) DISPOSABLE DISPENSER WITH FRAGRANCE DELIVERY SYSTEM

(75) Inventors: Joseph Mitchell, Alpharetta, GA (US); Debra Nell Welchel, Woodstock, GA (US); Richard Ignatius Wolkowicz, Ellenton, FL (US); Ning Yang, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 283 days.

(21) Appl. No.: 10/334,757

(22) Filed: Dec. 31, 2002

(65) Prior Publication Data

US 2004/0124101 A1 Jul. 1, 2004

(51) Int. Cl.
*B65D 85/16* (2006.01)

(52) U.S. Cl. ..... 206/213.1; 206/494; 206/812

(58) Field of Classification Search ..... 206/213.1, 206/216, 233, 494, 812
See application file for complete search history.

(56) References Cited

U.S. PATENT DOCUMENTS 2,806,738 A 9/1957 Tsakalas
2,849,152 A 8/1958 Tuttle
3,036,729 A 5/1962 Asman
3,038,473 A * 6/1962 Ladd ..... 604/306

(Continued)

FOREIGN PATENT DOCUMENTS

WO 99/06021 2/1999

OTHER PUBLICATIONS

Internet Pages, Aromatherapy Basics, Sep. 19, 2002.

Internet Pages, Aromatherapy for Women and Children: Pregnancy and Childbirth, Sep. 25, 1998.

Internet Pages, The Guide to Aromatherapy, Sep. 23, 1998.

*Primary Examiner*—Jacob K. Ackun, Jr.
(74) *Attorney, Agent, or Firm*—Douglas H. Tulley, Jr.; Sue C. Watson

(57) ABSTRACT

Disposable dispensers for stacks of tissue products are provided that include one or more odor control agents and one or more means for containing and releasing the odor control agents. When the means for containing and releasing the odor control agents is activated the odor control agents are released into the surrounding environment. The odor control agents include fragrant materials, odor-absorbing materials and materials that yield chemically active vapors.

19 Claims, 6 Drawing Sheets

U.S. PATENT DOCUMENTS 3,083,866 A 4/1963 Strange
3,369,699 A 2/1968 Enloe et al.
3,516,846 A 6/1970 Matson
3,516,941 A 6/1970 Matson
3,650,882 A 3/1972 Thomas
3,711,024 A * 1/1973 Hammond ..... 239/55
3,849,241 A 11/1974 Butin et al.
3,996,156 A 12/1976 Matsukawa et al.
4,041,203 A 8/1977 Brock et al.
4,087,376 A 5/1978 Foris et al.
4,100,324 A 7/1978 Anderson et al.
4,252,236 A 2/1981 Roccaforte
4,409,156 A 10/1983 Hoshi et al.
4,411,374 A 10/1983 Hotchkiss
4,469,243 A 9/1984 Ito et al.
4,483,759 A 11/1984 Szycher et al.
4,493,869 A 1/1985 Sweeny et al.
4,513,862 A * 4/1985 Mallow ..... 206/233
4,623,074 A 11/1986 Dearwester
4,638,921 A 1/1987 Sigl et al.
4,654,256 A 3/1987 Doree et al.
4,699,823 A 10/1987 Kellenberger et al.
4,720,415 A 1/1988 Vander Wielen et al.
4,752,496 A 6/1988 Fellows et al.
4,753,646 A 6/1988 Enloe
4,777,073 A 10/1988 Sheth
4,781,962 A 11/1988 Zamarripa et al.
4,808,408 A 2/1989 Baker et al.
4,818,600 A 4/1989 Braun et al.
4,828,556 A 5/1989 Braun et al.
4,877,154 A 10/1989 Matsui
4,880,690 A 11/1989 Szycher et al.
4,901,889 A 2/1990 Mitchell
4,908,252 A 3/1990 Carnahan et al.
4,961,493 A 10/1990 Kaihatsu
4,965,122 A 10/1990 Morman
5,043,161 A 8/1991 Scarpelli et al.
5,048,589 A 9/1991 Cook et al.
5,071,704 A 12/1991 Fischel-Ghodsian
5,093,182 A 3/1992 Ross
5,122,407 A 6/1992 Yeo et al.
5,180,637 A 1/1993 Sumii
5,188,236 A 2/1993 Sayers et al.
5,219,421 A 6/1993 Tipping
5,284,703 A 2/1994 Everhart et al.
5,297,732 A 3/1994 Hahn
5,312,021 A * 5/1994 Nelson ..... 222/183
5,385,775 A 1/1995 Wright
5,389,412 A 2/1995 Tanaka et al.
5,391,420 A 2/1995 Bootman et al.
5,392,590 A 2/1995 Ambrose et al.
5,415,320 A 5/1995 North et al.
5,607,551 A 3/1997 Farrington, Jr. et al.
5,624,025 A * 4/1997 Hixon ..... 206/233
5,714,107 A 2/1998 Levy et al.
5,740,913 A 4/1998 McFarland
5,769,832 A 6/1998 Hasse
5,769,833 A 6/1998 Hasse
5,858,515 A 1/1999 Stokes et al.
6,075,179 A 6/2000 McCormack et al.
6,077,590 A 6/2000 Archer et al.
6,096,152 A 8/2000 Anderson et al.
6,147,037 A 11/2000 Gardlik et al.
6,202,889 B1 3/2001 Veith
6,229,061 B1 5/2001 Dragoo et al.
6,315,864 B1 11/2001 Anderson et al.
6,369,290 B1 4/2002 Glaug et al.
6,403,186 B1 6/2002 Tararuj et al.
6,410,823 B1 6/2002 Daley et al.
6,415,949 B1 7/2002 Tramontina

* cited by examiner

DISPOSABLE DISPENSER WITH FRAGRANCE DELIVERY SYSTEM

BACKGROUND OF THE INVENTION

Facial tissues, napkins, paper towels, bathroom tissues, wipes and other tissue products enjoy widespread use. Individual hand-sized sheets are often available throughout the home as well as available in the workplace, restaurants, public facilities and so forth. Thus, there exists a wide array of dispensers designed to dispense such products. Due to the widespread use of tissue products throughout the home, numerous dispensers are available that are portable and also disposable. By way of example, tissue products are commonly available in "pop-up" boxes. In this regard, withdrawal of a first sheet through a dispenser opening pulls the enveloped portion of a second sheet through the dispenser opening such that it extends out of the dispenser opening and is exposed. Having a portion of the subsequent sheet extending out of the dispenser opening greatly facilitates removal of the same from the dispenser by the user. Examples of such pop-up dispensers are described in U.S. Pat. No. 5,740,913 to McFarland; U.S. Pat. No. 5,415,320 to North et al. and U.S. Pat. No. 3,369,699 to Enloe et al. These dispensers come in a variety of configurations and are available in numerous aesthetically pleasing designs and prints. These and other portable dispensers are commonly placed about the home, work place as well as other locations and are a well accepted accoutrement to most any living or working room.

Thus, in addition to dispensing tissue products, it would be desirable for the dispensers to also function to control unpleasant odors and/or to provide pleasing fragrances. In addition, certain aromas have been specifically employed in folk remedies as well as what is commonly referred to as "aromatherapy." In this regard, certain aromas are believed to help individuals obtain or reach certain moods or feelings, such as sleepiness, relaxation and so forth. Many essential oils have been employed in this respect. Thus, dispensing systems that allow for the controlled release of one or more such fragrances in conjunction with tissue products are likewise desirable.

SUMMARY OF THE INVENTION

Accordingly, disposable tissue dispensers are provided comprising (i) a plurality of walls defining a containment area and having a dispensing opening therein; (ii) a stack of tissue products within the containment area; (iii) an odor control agent; and (iv) a means for containing and releasing the odor control agent. The means for containing and releasing the odor control agent is located upon the outside of one or more of the dispenser walls. In addition, the disposable dispenser can include one or a plurality of means for containing and releasing the odor control agent. In one embodiment, the one or more means for containing and releasing the odor control agent is positioned upon a single side wall of the dispenser. In a further embodiment, when employing a plurality of means of containing and releasing the odor control agents, the means can be adapted to be activated independently of one another. The location of the dispensing opening can vary and, as an example, can be at least partially located within the top wall of the dispenser. The composition of the odor control agent can vary as desired and, desirably, is selected from the group consisting of fragrant materials and odor absorbing materials.

In a further aspect of the present invention, a disposable dispenser is provided comprising a plurality of side walls and top and bottom walls that define an inner containment area and at least one dispensing opening. A stack of tissue products is located within this inner containment area. The dispenser further includes a binder, positioned over one or more walls, with a carrier at least partially located therein. Various carriers can be utilized such as, for example, microcapsules and microsponges. The carriers in turn contain an odor control agent. A pull-strip overlies the binder wherein removal of the pull-strip releases the odor control agent to the surrounding environment. In one embodiment, the binder is positioned over a first sidewall. In a further embodiment, the dispenser includes multiple discrete sections of binder and corresponding carriers and odor control agents. Still further, the multiple discrete sections of binder can each have a corresponding pull-strip that can be independently removed there from. In one embodiment, the binder can have an appearance substantially similar to the appearance of the underlying sidewall. In an alternate embodiment, the binder can be substantially transparent. In still a further embodiment, the pull-strip can have an appearance substantially similar to the appearance of the underlying sidewall. While the composition of the odor control agents can vary as desired, in certain embodiments, the odor control agents can comprise a volatile fragrant material.

In a further aspect of the present invention, a disposable dispenser is provided comprising a plurality of walls defining an inner containment area and having at least one dispensing opening therein. A stack of tissue products is positioned within this inner containment area. Attached to one or more walls of the dispenser is a patch having a sealed cavity that contains one or more odor control agents. In one embodiment, the patch can include a first barrier layer attached to a second barrier layer wherein at least a portion of the second barrier layer is detachable from the first barrier layer in order to expose the cavity and odor control agents therein. In one embodiment, the first and/or second barrier layers comprise a flexible film. Further, in certain embodiments, a portion of the second barrier layer is unattached to the first barrier layer such as, for example, along an edge or corner thereof. The first barrier layer can be attached to the dispenser by one or more attachment mechanisms such as, for example, an adhesive. Further, in certain embodiments, the odor control agent can be further contained by a carrier such as, for example, polymeric matrices, microcapsules, microsponges and so forth. Still further, the dispenser can include more than one patch.

In still a further aspect of the invention, an odor control system is provided comprising a package having front and back panels connected to one another by a plurality of side panels. The package contains a plurality of dispensers containing tissue products and a release sheet having a plurality of removably-affixed patches thereon. The release sheet is positioned between the package and dispensers. The patches can contain one or more odor control agents. Further, the patches have an adhesion layer that is attached to a low adhesion surface of the release-sheet. Thus, the adhesion layer on the patch remains substantially intact when it is removed from the release sheet and allows the patch to be attached to another surface. In one embodiment, the planar surface of the release sheet having the patches thereon is positioned facing the dispensers and away from the package. In a further embodiment, the patches can include a sealed cavity formed by at least one barrier layer wherein the odor control agent is contained within this cavity. In further embodiments, the odor control agent is maintained within a carrier such as, for example, polymeric matrices, microcapsules, microsponges and so forth. Still further, the ratio of patches to dispensers can vary as desired and, as an example, can vary between 1:10 and 5:1.

DEFINITIONS

As used herein, the term "comprising" is inclusive or open-ended and does not exclude additional unrecited elements, compositional components, or method steps. Accordingly, the term "comprising" encompasses the more restrictive terms "consisting essentially of" and "consisting of."

As used herein the term "odor control agents" refers to fragrant materials, odor absorbing and/or odor masking materials.

As used herein the term "carrier" refers to any suitable composition or mechanism capable of maintaining and/or containing the odor control agents and further capable of subsequently releasing the odor control agents.

As used herein, the term "stack" is used broadly to include any collection of tissue products wherein there is a plurality of surface-to-surface interfaces. This not only includes a vertically stacked collection of individual sheets, but also includes a horizontally stacked collection of individual sheets as well as a rolled or folded collection of continuous sheet material.

DESCRIPTION OF THE INVENTION

Disposable tissue product dispensers come in a wide array of configurations and styles. By way of example only, various tissue product dispensers are described in U.S. Pat. Nos. 6,202,889; 5,740,913; 5,415,320; 4,469,243; 3,369,699; 3,083,866; 3,036,729 and so forth. The dispenser can be made of any one or more inexpensive materials such as plastic, paperboard, cardboard, metal foil and so forth. As described in the aforesaid patents and as is known in the art, the dispensers and tissue products can be adapted to provide "pop-up" or "pop-out" functionality. In this regard, the tissue product can be inter-folded and/or perforated as desired to improve and enhance dispensing. Exemplary methods for inter-folding tissue products include, but are not limited to, those described in U.S. Pat. Nos. 3,401,928; 3,679,094; 3,817,514; 3,841,620; 4,131,271; 4,502,675; 5,868,276; 6,045,002; 6,168,848; and 6,286,713. The nature and/or composition of the tissue sheets dispensed can vary widely. By way of example only, tissue products can include one or more of the following materials: wood pulp, pulp fluff, natural cellulose, synthetic cellulose, polymeric fibers or filaments and so forth. Further, the tissue products can comprise entirely or partly of recycled materials. Exemplary tissue products include, but are not limited to, those described in U.S. Pat. Nos. 3,301,746; 3,322,617; 3,650,882; 4,100,324; 4,737,393; 5,048,589; 5,284,703; 5,399,412; 5,494,554; 5,607,551; 5,672,248; 5,772,845; 5,776,306; 6,077,590; 6,273,996; and 6,096,152.

Figure 1:
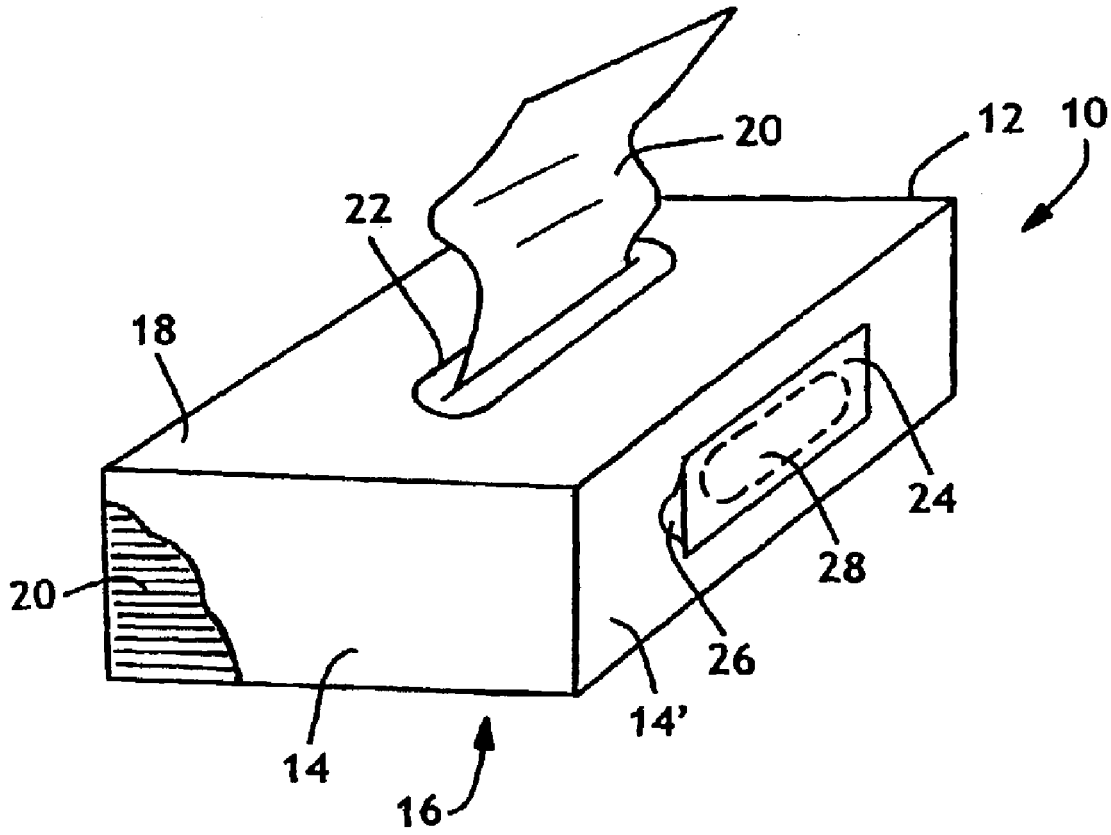
FIG. 1 is a partially elevated view of a tissue sheet dispenser having a device thereon for delivering odor control agents.

In reference to FIG. 1, a dispensing system 10 can comprise a dispenser housing 12 having sidewalls 14, bottom wall 16 and top wall 18. The walls 14, 16, 18 collectively form a containment area that holds tissue sheets 20. The tissue sheets 20 can be retrieved from the dispenser housing 12 through the dispensing opening 22. While the dispensing opening 22 is shown in the top wall 18 it will be understood by those skilled in the art that the dispensing opening can be placed in any wall that will be substantially exposed to the user. In addition, while not shown, it will likewise be understood that more than one dispensing opening can be provided and further that the dispensing opening can span one or more walls. Odor control agent 28 (shown in phantom) overlies sidewall 14' of the dispenser housing 12. In this regard, the odor control agent 28 can be placed upon any outer location of the dispenser housing 12 that will remain at least substantially exposed when in use. As discussed in more detail herein below, the release mechanism and/or carriers selected to maintain and release the odor control agents 28 can vary as desired. In reference to the embodiment depicted in FIG. 1, a pull-strip 24 is attached to the dispensing system 10 and completely overlays the odor control agent 28. Removal of the pull-strip 24 activates and/or exposes the odor control agent 28 and allows the agent to be released into the surrounding air environment. A tab 26 or other projection can be provided extending above and/or unattached to the wall 14' or odor control agent 28 in order to facilitate removal of the pull-strip 24.

Figure 2:
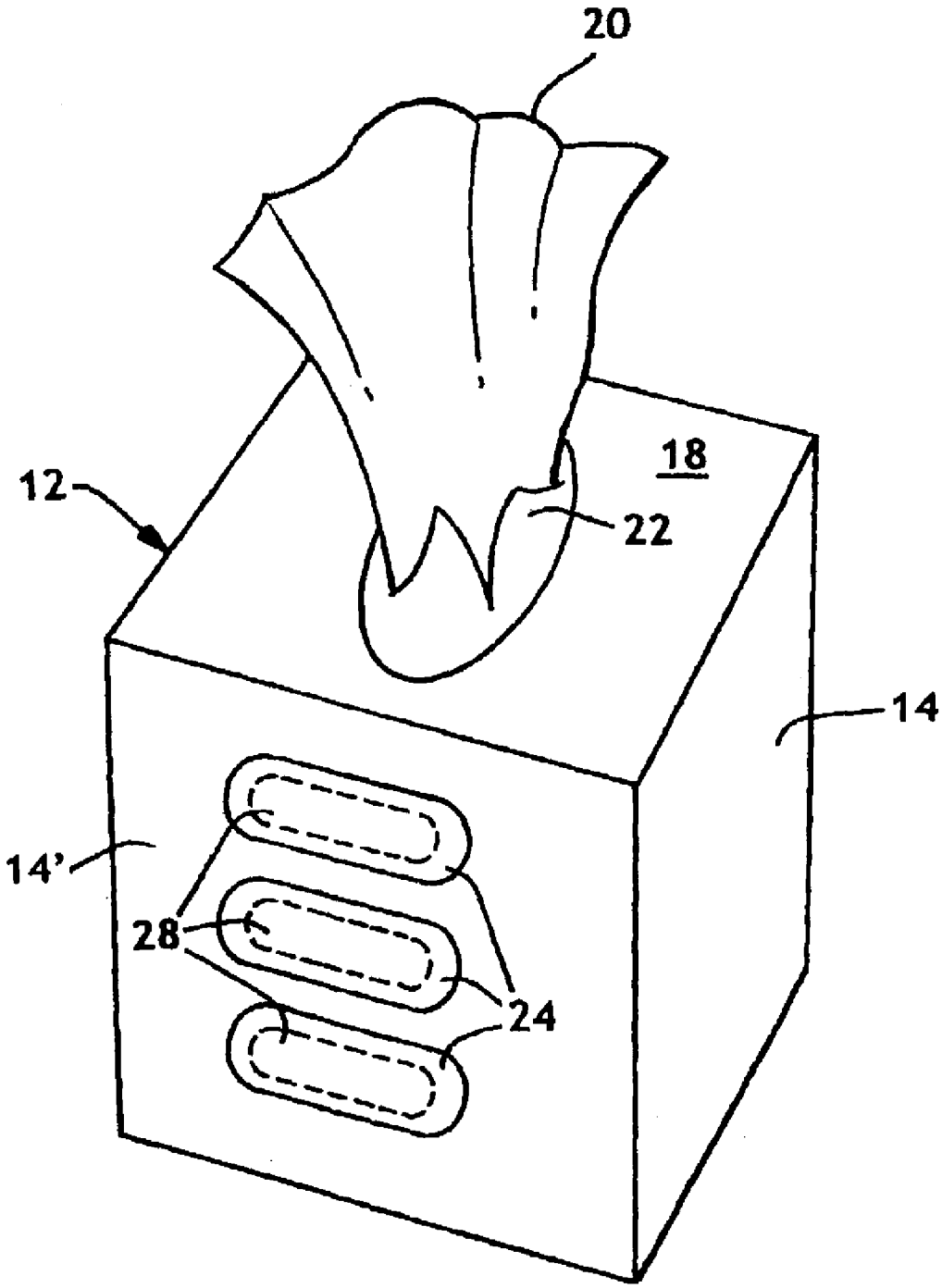
FIG. 2 is a partially elevated view of a tissue sheet dispenser having a plurality of devices thereon for delivering odor control agents.

In an alternate embodiment, a dispensing system can be provided having a plurality of release mechanisms and associated odor control agents. As a specific example and in reference to FIG. 2, a side wall 14' has multiple discrete sections or portions of odor control agent 28 attached to the sidewall 14'. Superposing the odor control agents 28 are multiple discrete pull-strips 24, each pull-strip 24 being associated with a different portion of odor control agent 28. Having multiple, discrete release mechanisms allows the user to control the amount of odor control agent released into the surrounding environment. In this regard, pulling more than one pull-strip will cause the release of a greater amount of odor control agent and a corresponding increase in the degree or strength of the associated fragrance. In a further aspect, individuals use tissue products at varying rates depending on family size, wellness and numerous other factors. Thus, having multiple release mechanisms also allows for the sustained release of the odor control agent over longer periods.

Figure 3:
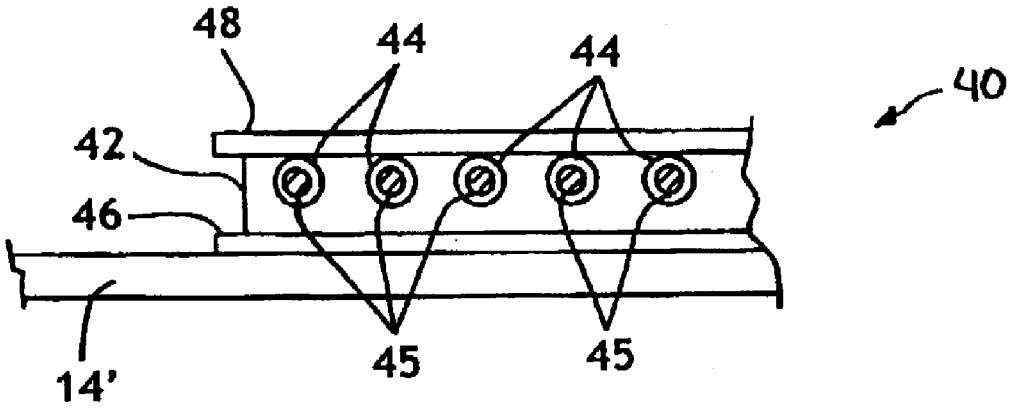
FIGS. 3 and 3A are a cross-sectional side views of an exemplary device for delivering odor control agents.
Figure 3A:
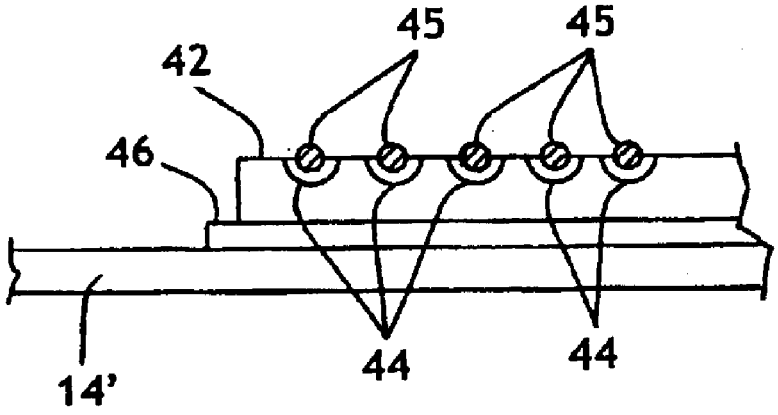

Numerous different release mechanisms for holding and subsequently releasing the odor control agent are believed suitable for use in the present invention. As an example, various types of microcapsules are available that are adapted to release fragrances or other materials. In one aspect, microcapsules encapsulate the odor control agent and upon shearing or rupturing the microcapsule, one or more openings are created in the surface of the microcapsule through which the odor control agent will escape. Generally speaking, one or more substrate sheets are provided and have microencapsulated odor control agent disposed within a binder layer there between. The binder bonds the microcapsules to the substrate sheet and binds together the interior faces of the opposed substrate sheets. Thus, when a user separates the sheets apart, some or all of the microcapsules rupture, thereby exposing and/or releasing the odor control agent contained therein. As an example and in reference to FIGS. 3 and 3A, release mechanism 40 includes a binder material 42 containing microcapsules 44. The microcapsules in turn contain one or more odor control agents 45. The binder material 42 is attached to and positioned between a backing member 46 and pull-strip 48. The backing member 46 is affixed to an outer wall 14' of the dispenser housing 14'. Removal of the pull-strip 48 acts to rupture and/or shear open the microcapsules 44 thereby exposing the odor control agent 45. In an alternate embodiment (not shown), the binder material can be affixed directly to the wall of the dispenser housing without use of a backing member. Microsponges can also be used in connection with the present invention. Microsponges differ from microcapsules in that microsponges are substantially filled with a fragrance or other material as opposed to enveloping the material. However, since microsponges do not fully encapsulate the associated material, microsponges are commonly sealed within a small, contained area in order to prevent pre-mature release of the odor control agent. Merely exposing the microsponge to the air allows the fragrance to diffuse from or otherwise be released from the microsponge. Exemplary microspheres, microsponges and methods of using the same include, but are not limited to, those described in U.S. Pat. Nos. 3,516,941; 3,996,156; 4,409,156; 4,087,376; 4,493,869; 4,654,256; 4,808,408; 4,908,252 5,043,161 and 5,180,637; each of the aforesaid references are incorporated herein by reference.

The pull-strip and/or backing member can comprise any one of various materials including, but not limited to, polyolefin films, metal foils, metalized films or fabrics, nonwoven fabrics, cellulosic materials, and so froth. In addition, the pull-strip can optionally include printing that matches or compliments the colors and/or designs upon the walls of the dispenser housing. As a further option, the pull-strip and/or backing material can include one or more insignias, brand names, etc. In addition, the binder material and odor control agent can likewise be colored or patterned as desired to match or compliment artwork or design upon the outside of the walls forming the dispenser housing. In still a further embodiment, the microcapsules can be retained by a substantially transparent binder and/or backing member.

Figure 4:
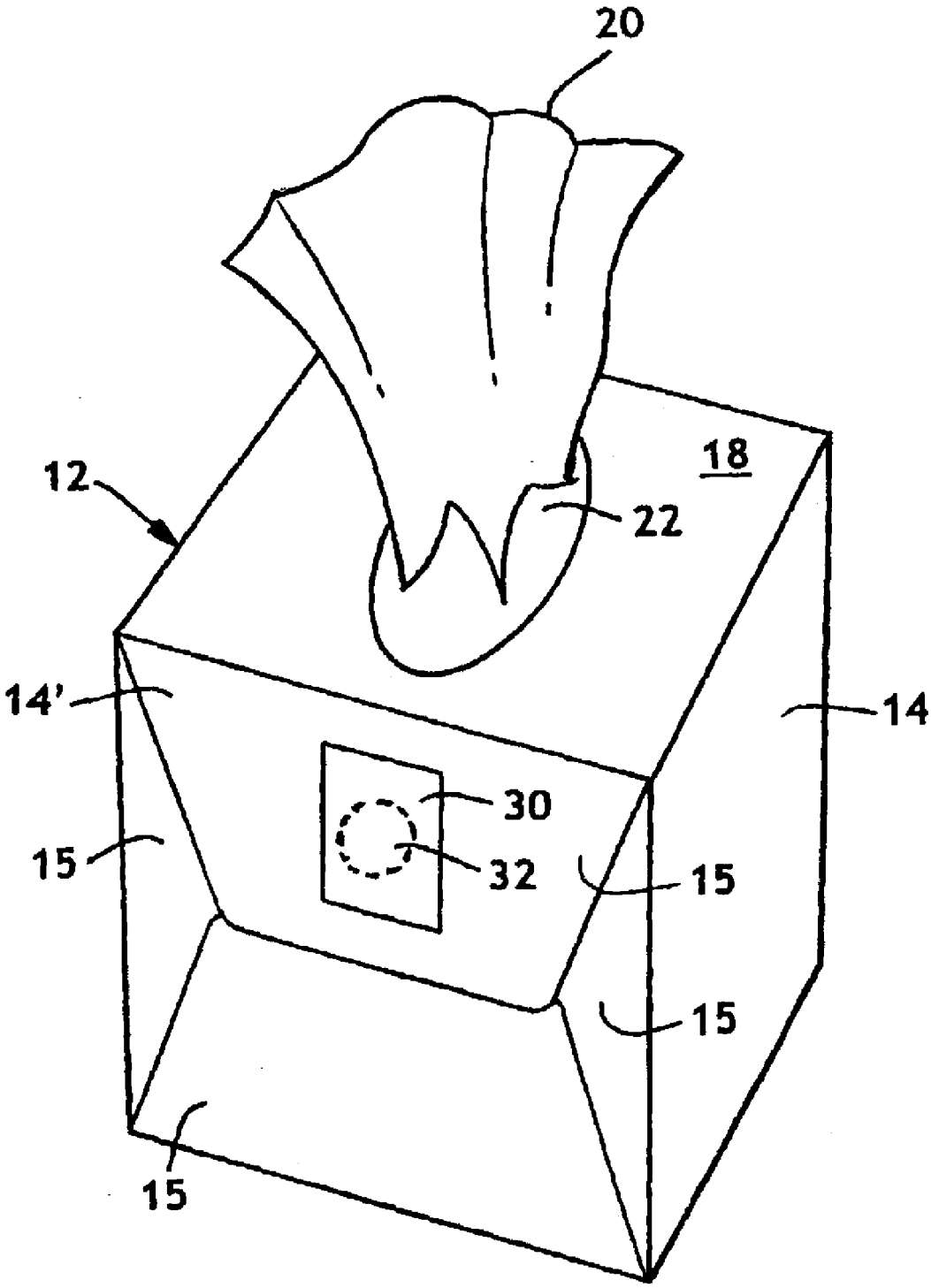
FIG. 4 is a partially elevated view of a tissue sheet dispenser having a device thereon for delivering odor control agents.

In a further embodiment of the present invention, a dispenser is provided including a container or patch that retains the odor control agents. The patch is desirably located upon one or more walls that will remain at least substantially exposed while the dispenser is in use. As an example and in reference to FIG. 4, dispenser housing 12 is defined by sidewalls 14, bottom wall 16 and top wall 18. A patch 30, containing odor control agent 32 (shown in phantom), is attached to sidewall 14'. In this particular embodiment, the patch 30 is attached to the sidewall 14', a side wall formed by overlapping flaps 15. The patch 30 can be permanently affixed to the dispenser housing 12 or, in the alternative, can be releasably-attached thereto. The patch can be attached, directly or indirectly, to the article by means of thermal or ultrasonic bonding, adhesives, hook and loop fasteners, friction fit, and other attachment mechanisms known to those skilled in the art. The patch 30 can be attached to one or more of the walls prior to inserting the tissue product or after the dispenser has been fully assembled and loaded. This particular construction also allows placement of the patch 30 during the manufacture of the dispensing system 10 or by the consumer just prior to use.

Figure 5:
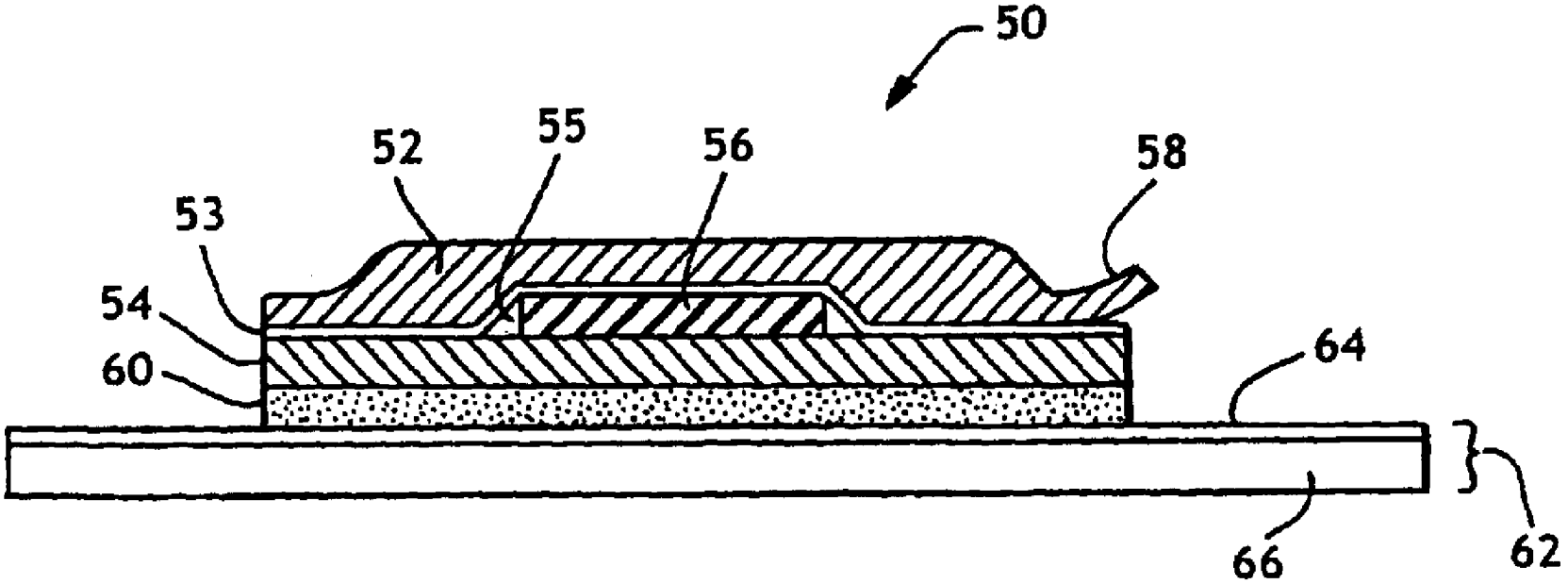
FIG. 5 is a cross-sectional side view of an exemplary patch for maintaining and delivering odor control agents.

An exemplary patch desirably comprises a sealed pouch or cavity, formed from one or more barrier layers. In one embodiment and in reference to FIG. 5, a patch 50 includes top and bottom barrier layers 52 and 54 respectively, sealed together to form an internal cavity 55 for retaining the odor control agents 56. Each barrier layer 52, 54 is desirably constructed of materials that are impermeable to out-flowing of carriers, odor control agents and any associated vapors and liquids. At least one of the sealed barrier layers 52 is substantially detachable, or otherwise removable from the opposed layer 54, so as to expose the odor control agents 56 located in the cavity 55 of the patch 50. Removal of the top barrier layer 52, such as by peeling the layer off the patch 50, exposes the internal cavity 55 and results in a release of the odor control agents 56 therein. The patch 50 can be manufactured to be readily attachable to other surfaces by including an adhesive material 60 to the bottom barrier layer 54. In addition, the top barrier layer also may include paper or other materials (not shown) in its upper structure so that labels, instructions, artwork and the like can be applied to the surface thereof to match or compliment the design or color on one or more of the walls of the dispenser housing. In an alternate embodiment (not shown), the patch can comprise a single layer of barrier material folded over onto itself and sealed about the edges to form a cavity.

The barrier layers 52, 54 can be heat-sealed together around the periphery of the patch 50 in order to hermetically seal the odor control agent 56 within the cavity 55. Desirably, a heat-sealing die uses heat and pressure to fuse the top and bottom barrier layers 52, 54 via an adhesion layer 53 applied to the top barrier layer 52. By way of example only, the adhesion layer 53 can comprise a low melt temperature polymer such as ethylene vinyl acetate (EVA). In order to aid removal of the top barrier layer 52 from the bottom barrier layer 54, a peripheral portion of the patch 50 remains unsealed such as, for example, an unsealed corner or edge 58. An alternative embodiment is to utilize a pressure sensitive adhesive or other adhesive as the adhesion layer 53 to seal the top and bottom barrier layers 52 and 54, thereby eliminating the necessity of heat sealing.

The barrier layers of the patch desirably comprise a thin mono-layer or multi-layer material suitable for preventing migration or seepage of odor control agents, for preventing oxygen from moving inside the pouch, and for hermetically sealing to itself or another layer or material. By way of example only, one suitable barrier material is a polyethylene/nylon/polyethylene laminate. The polyethylene and nylon laminate substantially reduces or eliminates seepage of the odor control agents from the cavity as well as the diffusion of oxygen to the inside of the pouch. In this regard, oxygen can degrade the integrity of the adhesive and odor control agent, respectively. As further examples, the barrier layer or layers can comprise a polyvinylidene dichloride (PVDC) type material, nylon, polyethylene, resin coated papers and laminates thereof. An exemplary PVDC material suitable for use within the barrier layer is commercially available under the trade name SARAN from the Dow Chemical Company. Desirably, at least one of the barrier layers is coated with an adhesive material in order to provide a seal between the layers as well as provide for a top layer that is readily removable from the lower layer. An exemplary embodiment of the top barrier member is a laminate comprising paper, polyethylene, metal foil and polyethylene, coated with EVA. Additional details regarding the construction of exemplary patches and methods of making the same are described in U.S. Pat. Nos. 5,391,420 and 4,880,690, the entire contents of each of which are incorporated herein by reference. In addition, one or more rate limiting membranes can be positioned over the cavity and/or between the barrier layers in order to control the rate at which the odor control agents are released from the patch. By way of example only, an exemplary rate limiting membrane is disclosed in U.S. Pat. No. 5,071,704.

Figure 6:
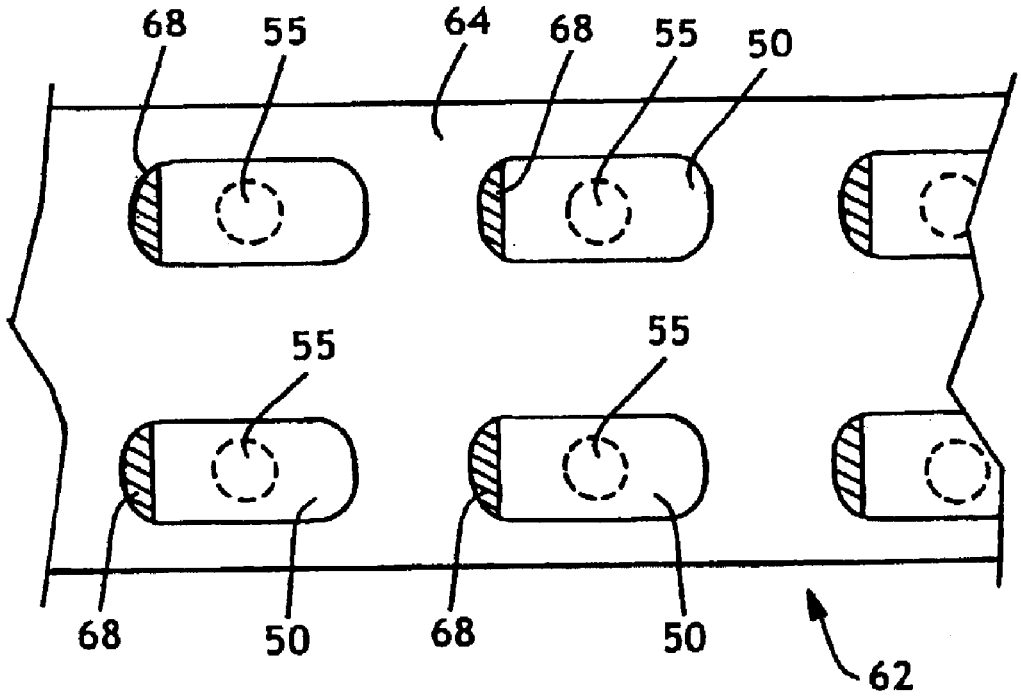
FIG. 6 is a top plan view of a section of a release sheet containing removable patches containing odor control agents.

When it is intended to allow placement of the patch upon the dispenser by the consumer, it will often be desirable to provide a plurality of patches 50 on larger sheets of a release sheet 62 such as depicted in FIG. 6. In reference again to FIG. 5, the adhesive 60 is located between the outer surface of the bottom barrier layer 54 and the low adhesion surface 64 of support material 66. By way of example only, suitable release sheets can comprise a low-adhesion material such as silicone-coated release paper or silicone-coated MYLAR sheet. The low adhesion surface on the release sheet 62 acts as a release liner, allowing removal of the adhesive 60 from the release sheet 62, thereby resulting in the maintenance of the integrity of the adhesive material 60 on the bottom barrier layer 54 when the patch 50 is removed from the release sheet 62 and applied to the surface of the dispenser as desired. It is also noted that this product configuration readily permits high-speed application from rolls to articles during or after the manufacture of the dispenser. Due to the nature of the release liner, the patches can be readily transferred from the release sheet onto a wall of a dispenser by drawing the release sheet over a support roller that turns the flexible release sheet to move at a substantial angle to its original direction. Suction may also be employed to aid in transfer of the patches to the outer surface of the dispenser.

Desirably, a carrier is utilized in conjunction with the odor control agent in order to stabilize the same and help prevent premature or unwanted leakage of the same from the cavity. The carrier can comprise one or more materials adapted to hold the odor control agents and then release the same upon exposure to air. Microcapsules and microsponges, such as described above, are exemplary carriers. As still further examples, the odor control agent can be maintained within a polymeric matrix such as a foam or foam-like material. Exemplary foams include, but are not limited to, urethane foams, styrene foams, polyolefin foams, polyvinylchloride foams, silicone foams and so forth. In still a further embodiment, the polymeric matrix can in effect be polymerized about or with the fragrant material in order to form a solid polymeric matrix doped with the fragrant material.

In one embodiment, a polymeric precursor can be mixed with the odor control agent and then cured to form a solid polymeric material about the odor control agent. In one embodiment, the top surface of the bottom barrier layer can be coated to a thickness of between about 0.005 cm and about 0.5 cm with a polymeric precursor doped with the odor control agent using an applicator such as a gravure roll, screen coater, and so forth. The odor control agent may simply be dispersed in the polymeric precursor by mechanical application such as, for example, stirring. After application to the bottom barrier layer 54, the doped polymeric precursor is cured into solid polymeric sections. Curing methods and times will vary with the selected polymer pre-cursors and/or initiators. By way of non-limiting example, exemplary polymers to which fragrant materials can be added include the ultra-violet light curable polyurethanes disclosed in U.S. Pat. Nos. 4,880,690 and 4,483,759; the entire contents of the aforesaid references are incorporated herein by reference. As a specific example, doped polymeric matrices can be formed from a composition including about 10 to 50 weight percent fragrance oil, about 50 to 90 weight percent polyurethane oligomer, and about 1 to 10 weight percent photo-initiator. The amounts may be varied as desired to maximize the aroma and cure speed flexibility of the doped polymer, the flexibility of the pouch and so forth.

In a further embodiment, the carrier can comprise one or more modified cellulosics such as ethyl cellulose, hydroxypropyl cellulose, hydroxyethyl cellulose, methyl cellulose, carboxymethyl cellulose and so forth. As a specific example, a polymer gel mixture suitable for use in the present invention can comprise about 10 to 40 percent by weight fragrance oil, about 30 to 70 percent by weight alcohol (e.g. ethyl alcohol), about 0.1 to 10 percent by weight modified cellulosic, 0 to about 0.1 percent by weight antioxidant, and the balance water. While various carrier materials are described herein, it is noted that still other matrices, gels and sponge-like materials can be used as a carrier in combination with the sealed patch.

The odor control agents can comprise any of a variety of materials including viscous and non-viscous liquids such as solutions, emulsions, dispersions, gels and so forth. Further, the odor control agents can also include solids having a distinct smell and that readily volatilize upon exposure to air such as, for example, certain organic solids. In one aspect of present invention, the odor control agents can comprise one or more fragrant materials or materials that provide chemically active vapors. The odor control agents selected should be chosen to be compatible with the barrier materials, binders, and/or any components that they may contact. In one embodiment, the odor control agents can comprise and/or include volatile, fragrant compounds including, but not limited to, perfumes, essences, fragrance oils, and so forth. As is known in the art, many essential oils and other natural plant derivatives contain large percentages of highly volatile scents. In this regard, numerous essential oils, essences, and scented concentrates are commonly available from companies in the fragrance and food businesses. Exemplary oils and extracts include, but are not limited to, those derived from the following plants: almond, amyris, anise, armoise, bergamot, cabreuva, calendula, canaga, cedar, chamomile, coconut, eucalyptus, fennel, jasmine, juniper, lavender, lemon, orange, palm, peppermint, quassia, rosemary, thyme, and so forth.

In a further aspect, the odor control agents can comprise and/or include odor-absorbing materials. Exemplary materials include, but are not limited to, cyclodextrins, zeolites, activated carbon and water-soluble antibacterial compounds, such as cetyl pyridinium chloride, zinc chloride, copper salts, copper ions, chlorhexidine, quaternary ammonium compounds, chelating agents, parabens, chitin, and so forth. Numerous varieties of intermediate zeolites suitable for use herein are commercially available under the trade names ADVERA and VALFOR from PQ Corporation of Valley Forge, Pa., USA.

It is noted that a significant number of suitable odor control agents are available and capable of use in the present invention. The selection of the particular agent or agents will vary in accord with the specific dispenser, the desired result (odor masking, odor absorbing, aromatherapy, etc.), user preferences, cost and so forth. Thus, the invention is not intended to be limited by the specific selection of the odor control agents contained therein.

Figure 7:
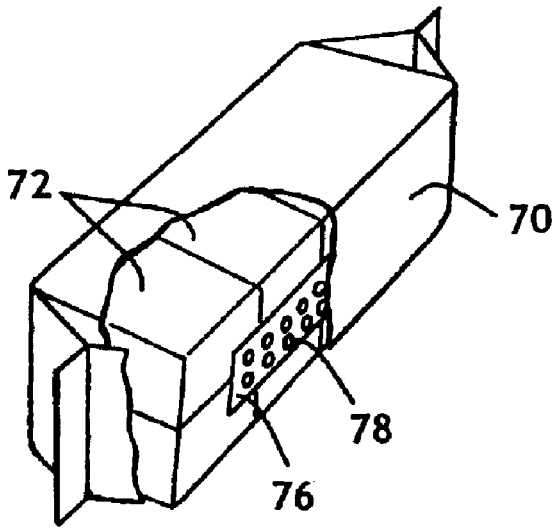
FIG. 7 is a representative view of a package containing a plurality of dispensers and an accompanying release sheet with removable patches

A system for providing dispensers and associated attachable delivery devices, for example patches, is also provided. In reference to FIG. 7, packaging 70 includes dispensers 72, which in turn house the tissue product (not shown), and a release sheet 76 containing a plurality of patches 78. Desirably, the sheet material 76 is provided with the patches 78 contacting the dispensers 72 thereby leaving flat sheet material exposed and in contact with the packaging 70 when sealed therein. By providing the sheet material 74 with the patches 76 facing the dispensers the potential for ripping the packaging material 70, either during loading or in shipping, is reduced. The sheet material 76 can be superposed with any face of the stacked dispensers 72. The number of patches provided can be more than, less then or equal to the number of dispensers provided within the packaging and can vary as desired. By way of example only, the ratio of patches to dispensers can vary between about 5:1 and about 1:10. In a specific embodiment, the ratio of patches to dispensers can be about 1:1. In a further aspect, the release sheet can contain patches having different odor control agents including, but not limited to, (i) having patches containing different fragrances, (ii) having patches containing different odor absorbing agents, (iii) having patches containing fragrances and patches containing odor absorbing agents, and still other combinations as may be desired.

While various patents and other reference materials have been incorporated herein by reference, to the extent there is any inconsistency between incorporated material and that of the written specification, the written specification shall control. In addition, while the invention has been described in detail with respect to specific embodiments and/or examples thereof, it will be apparent to those skilled in the art that various alterations, modifications and other changes may be made to the invention without departing from the spirit and scope of the present invention. It is therefore intended that the claims cover or encompass all such modifications, alterations and/or changes.

What is claimed is:

1. A disposable tissue dispenser comprising:

a dispenser having a plurality of walls and having a dispensing opening therein, the plurality of walls including a plurality of side walls and top and bottom walls;

a stack of tissue products within said dispenser;

an odor control agent;

a plurality of means for containing and releasing the odor control agent, wherein the plurality of means are positioned upon a single side wall, and wherein the plurality of means can be independently activated.

2. The disposable dispenser of claim 1 wherein said sidewall having said means for containing and releasing said odor control agent is formed by at least two overlapping flaps.

3. The disposable dispenser of claim 1 wherein said dispensing opening is at least partially located within said top wall.

4. The disposable dispenser of claim 1 wherein said odor control agent comprises a compound selected from the group consisting of fragrant materials and odor absorbing materials.

5. The disposable dispenser of claim 1 wherein said odor control agent includes an essential oil.

6. A disposable dispenser comprising:

a plurality of side walls and top and bottom walls, said walls defining an inner containment area and having at least one dispensing opening therein;

a stack of tissue products within said inner containment area;

a first binder positioned over said walls, distal to said inner containment area;

a first carrier selected from the group consisting of microcapsules and microsponges and wherein said carrier is at least partially located within said binder;

a first odor control agent within said first carrier; and a first pull-strip overlying said first binder for releasing said first odor control agent.

7. The disposable dispenser of claim 6 wherein said binder is positioned over a first sidewall.

8. The disposable dispenser of claim 7 further including a second binder positioned over said walls, distal to said inner containment area; a second carrier at least partially located within said binder; a second odor control agent within said second carrier; and a second pull-strip overlying said second binder for releasing said second odor control agent.

9. The disposable dispenser of claim 8 wherein said first and second pull-strips can be independently removed from the first and second binders.

10. The disposable dispenser of claim 7 wherein said binder has an appearance substantially similar to the appearance of said first sidewall.

11. The disposable dispenser of claim 6 wherein said binder is substantially transparent.

12. The disposable dispenser of claim 7 wherein said pull-strip has an appearance substantially similar to the appearance of said first sidewall.

13. The disposable dispenser of claim 6 wherein said odor control agent includes a volatile fragrant material.

14. An odor control system for tissue products comprising:

a package having front and back panels connected to one another by a plurality of side panels;

a plurality of dispensers, said dispensers containing tissue products;

a release sheet having a first planar surface and a second planar surface, said first planar surface of said release sheet comprising a low adhesion surface and having plurality of removably-affixed patches thereon;

said patches including an odor control agent therein and an adhesive layer contacting said first planar surface of the release sheet; and wherein said package contains both said release sheet and said dispensers and further wherein said release sheet is positioned adjacent said dispensers.

15. The system of claim 14 wherein said second planar surface is proximate said package.

16. The system of claim 15 wherein said patches include a sealed cavity formed by at least one barrier layer and wherein said odor control agent is contained within said cavity.

17. The system of claim 14 wherein said odor control agent is maintained within a carrier.

18. The system of claim 17 wherein said carrier is selected from the group consisting of microcapsules, microsponges, and polymeric matrixes and further wherein said odor control agent comprises a volatile, fragrant material.

19. The system of claim 14 wherein the ratio of patches to dispensers is between 1:10 and 6:1.

* * * * *